United States Patent [19]

Torii et al.

[11] 4,235,462

[45] Nov. 25, 1980

[54] DOOR LOCKING APPARATUS FOR VEHICLES

[75] Inventors: Nozomu Torii, Hekinan; Yoshiaki Ishikawa, Chiryu, both of Japan

[73] Assignee: Aisin Seiki Kabushiki Kaisha, Kariya, Japan

[21] Appl. No.: 888,998

[22] Filed: Mar. 22, 1978

[30] Foreign Application Priority Data

Apr. 20, 1977 [JP] Japan ..... 52-50200

[51] Int. Cl.[3] ..... E05C 3/26

[52] U.S. Cl. ..... 292/216; 292/DIG. 38

[58] Field of Search ..... 292/216, 341.12, DIG. 56; 70/463

[56] References Cited

U.S. PATENT DOCUMENTS

| | | | |
|---|---|---|---|
| 2,435,987 | 2/1948 | Tierney et al. | 292/341.12 X |
| 2,694,591 | 11/1954 | Anschuetz | 292/216 |
| 2,860,905 | 11/1958 | Wiese | 292/341.12 |
| 3,495,863 | 2/1970 | Gergoe | 292/216 |
| 3,697,105 | 10/1972 | Marx | 292/216 |
| 4,073,519 | 2/1978 | Kurozu et al. | 292/216 |

*Primary Examiner*—Richard E. Moore

*Attorney, Agent, or Firm*—Oblon, Fisher, Spivak, McClelland & Maier

[57] ABSTRACT

A door locking apparatus which includes a striker member fixed to a vehicle body; a latch member rotatably supported in a main body of a door and engageable with the striker member; a pawl member urged in the direction of the latch member so as to engage with the latch member and limit the rotation of the latch member, wherein the pawl member is provided with an engaging groove at a contacting portion with the latch member; and a shock absorbing member fixedly inserted into the groove.

5 Claims, 3 Drawing Figures

DOOR LOCKING APPARATUS FOR VEHICLES

BACKGROUND OF THE INVENTION

1. Field of the Invention

The present invention relates generally to a door locking apparatus and more particularly to such an apparatus for vehicles.

2. Description of the Prior Art

In general, the noise produced upon door closing is offensive to the ear so that it has become necessary to avoid such noise. The noise results from the fact that latch, pawl and striker members are made of a metal so that a metallic noise is produced by the metallic contact among them, with the impact noise upon contacting the pawl member by the rotation of the latch member being much larger than the noise upon contacting the latch member with the striker member.

A door locking apparatus according to the present invention comprises an engaging groove at an engaging portion of a pawl member and a latch member, and a shock absorbing member, having a predetermined flexibility, fixedly inserted into the engaging groove, an outer surface of the shock absorbing member being deformably urged to thereby absorb the impact force produced upon striking of the pawl member by the rotation of the latch member and preventing dislocation of the shock absorbing member from the pawl member.

SUMMARY OF THE INVENTION

The present invention provides an improved door locking apparatus which obviates the drawbacks of the above-mentioned conventional door locking apparatus.

The door locking apparatus according to the present invention provides a unique and highly simplified door locking apparatus.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
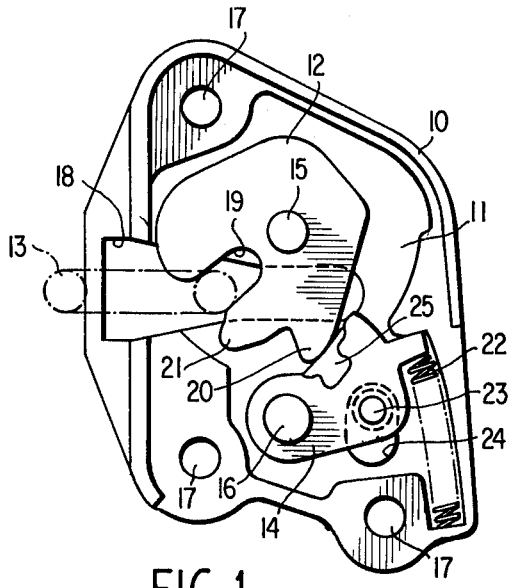
FIG. 1 is an elevational view showing an embodiment according to the present invention.
Figure 2:
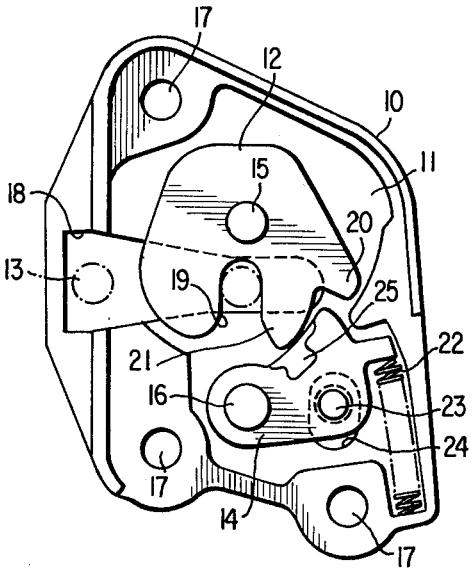
FIG. 2 is a similar view to FIG. 1, however, showing a partial actuating state according to the present invention.

As best seen in FIG. 1, reference numeral 10 denotes a door locking main body made of plastic and is provided with a recess portion 11. A latch member 12 engaging with a striker member 13 and a pawl member 14 engaging with the latch member 12 are rotatably supported by shafts 15, 16 on the recess 11, respectively.

Both sides of the main body 10 is squeezed by a plate member and a subplate member (not shown) attached with an operating member (not shown). The reference numeral 17 designates an attaching hole for fixedly mounting the main body 10 on a door (not shown). A groove 18 is formed by the recess 11 of the main body 10 and a recessed groove (not shown) of the plate member in order to allow the introduction of the striker member 13 along the groove 18. The latch member 12 is provided with a recess 19 engaging with the striker member 13, a half latch projection portion 20 and a full latch projection portion 21.

Pawl member 14 is urged by a spring 22 into the counter-clockwise direction. Reference numeral 23 designates a pin operatively connecting the pawl member 14 and an opening lever (not shown). The pin 23 is displaceable within an elongated hole 24 of the recess 11.

A shock absorbing member 25 is fixedly inserted into an engaging groove 26 which is formed on the whole axial portion contacting the pawl member 14 with the latch portions 20, 21 of the latch member 12. The shock absorbing member 25 is made of plastic material, etc. having a predetermined flexibility characteristic.

Figure 3:
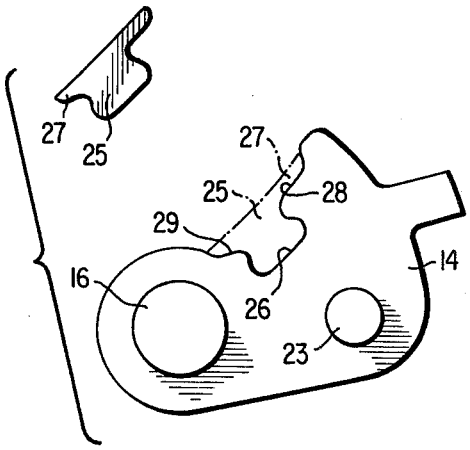
FIG. 3 is a similar view to that of FIG. 1, showing an attaching state of a shock absorbing member into a pawl member of the present invention.

A flat plate portion 27 of the shock absorbing member 25 is sunk at the central portion thereof in accordance with its flexibility characteristic as shown by a chain and dotted line in FIG. 3 and is deformably urged into a circular arc shape or concave configuration. The urging direction of the flat plate portion 27 is acted in the depth direction of the groove 26 so that the flat plate portion 27 comes closely into contact with faces 28, 29 of the groove 26 and the shock absorbing member 25 is attached to the contacting portion of the pawl member 14 with the latch member 12.

The engaging portion of the shock absorbing member 25 is fixedly engaged with the groove 26 in a tapered shape and is prevented from being dislocated or dislodged from the groove 26. The prevention of the shock absorbing member 25 becoming vertically displaced from the rotational actuating surface of the pawl member 14 is performed by the urging force in the depth direction of the shock absorbing member 25 itself in the groove 26.

The operation of the invention will now be described hereinbelow in greater detail.

When the striker member 13 is rightwardly entered into the groove 18, the striker member 13 is engaged with the recess 19 of the latch member 12. The latch member 12 is rotated into the counterclockwise direction about the shaft 15 by further rightward displacement of the striker member 13 so that the half latch portion 20 of the latch member 12 is contacted with the pawl member 14 as shown in FIG. 1. However, the shock absorbing member 25 is provided at the contacting portion of the pawl member 14 and the latch member 12 so that the impact force produced by the contact of the pawl member 14 and the latch member 12 is absorbed by the flexibility of the shock absorbing member 25 and any corresponding impact noise is prevented.

When the striker member 13 is further rightwardly displaced in the groove 18, the latch member 12 is rotated in the counterclockwise direction about the shaft 15, and the half latch portion 20 of the latch member 12 is disposed over the pawl member 14 against the urging force of the spring 22 while the pawl member 14 is urged into the clockwise direction by the half latch portion 20 of the latch member 12 about the shaft 17. Thereafter, the full latch portion 21 of the latch member 12 is contacted with the pawl member 14 which is rotated into the counterclockwise direction about the shaft 16 by receiving the urging force of the biased spring 22.

Also, in this case, the shock absorbing member 25 is provided at the contacting portion of the pawl member 14 and the latch member 12 so that the impact noise is thus prevented. When the striker member 13 reaches the right end of the groove 18, the full latch portion 21 is disposed over the pawl member 14, the pawl member 14 is engaged with the recess 19 of the latch member 12 and the rotation of the latch member 12 is stopped to thereby maintain a fully closed position of the door.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by U.S. letters patent is:

1. A door locking apparatus for vehicles, which comprises:

a striker member fixed to a vehicle body;

a latch member rotatably supported in a main body of a door and engageable with said striker member;

at least one latch portion formed on the latch member;

a pawl rotatably supported on the door and urged in the direction toward said latch member to engage the latch member and limit rotation thereof, said pawl having an irregularly shaped groove therein at the area of contact with the latch member; and a generally anvil-shaped body of resilient shock absorbing material fitted in said groove and retained in the groove by projecting portions thereof engaged in undercut parts of the groove, said shock absorbing body having an elongate surface defining a contact zone with the latch member and being stressed by dimensional differences between the shock absorbing body and the groove into an arcuate, convex configuration for smooth engagement with the latch member.

2. A door locking apparatus for vehicles as set forth in claim 1, wherein;

said shock absorbing body includes a flexibility characteristic.

3. A door locking apparatus for vehicles as set forth in claim 1, wherein;

said shock absorbing body is made of a plastic material.

4. A door locking apparatus for vehicles as set forth in claim 1 wherein:

said shock absorbing means is supported solely by said groove in said pawl member.

5. A door locking apparatus for vehicles as set forth in claim 1, wherein:

said at least one latch portion comprises at least a first half-latch projecting portion and a second full latch projecting portion formed on said latch member which directly contact said shock absorbing means for partially and fully latching said latch member.

* * * * *